US005348263A

United States Patent [19]

Hubbard

[11] Patent Number: 5,348,263

[45] Date of Patent: Sep. 20, 1994

[54] PORTABLE EXPANDABLE LAP DESK

[76] Inventor: Frank M. Hubbard, 118 Wig Hill Rd., Chester, Conn. 06412

[21] Appl. No.: 138,347

[22] Filed: Oct. 18, 1993

[51] Int. Cl.[5] ..... A47B 97/04

[52] U.S. Cl. ..... 248/444; 248/460

[58] Field of Search ..... 248/444, 450, 459, 460, 248/461, 465, 448, 455, 473; 108/43, 44

[56] References Cited

U.S. PATENT DOCUMENTS

| | | | |
|---|---|---|---|
| 346,547 | 8/1886 | Holt | 248/444 |
| 643,164 | 2/1900 | Schnell | 248/444 |
| 2,640,747 | 6/1953 | Bodenhoff | 248/444 |
| 4,215,838 | 8/1980 | Gullota | 248/316.7 X |
| 4,700,634 | 10/1987 | Mills | 248/444 X |
| 4,886,231 | 12/1989 | Doerksen | 248/455 |
| 5,150,873 | 9/1992 | Donovan | 248/460 |

FOREIGN PATENT DOCUMENTS

| | | | |
|---|---|---|---|
| 362778 | 11/1922 | Fed. Rep. of Germany | 248/444 |
| 470414 | 9/1914 | France | 248/444 |
| 769480 | 3/1957 | United Kingdom | 248/444 |

*Primary Examiner*—J. Franklin Foss

*Attorney, Agent, or Firm*—Hedman, Gibson & Costigan

[57] ABSTRACT

This invention relates to a portable expandable desk comprising a first substantially rigid flat surface member; a second substantially rigid flat surface member; a means for hingedly attaching the first surface member to the second surface member so that the first and second surface members are capable of folding together; and a means for bracing the first surface member and the second surface member in an unfold position wherein the bracing means comprises a gripping means to prevent the bracing means from inadvertently disengaging from the first or second surface member.

12 Claims, 3 Drawing Sheets

PORTABLE EXPANDABLE LAP DESK

FIELD OF THE INVENTION

This invention relates to a portable expandable auxiliary desk for reading, writing, editing, eating or any other type of activity for which a conventional desk or table may be used but is not available, practical or desirable.

BRIEF DESCRIPTION OF THE RELATED ART

Portable auxiliary desk are known in art. For example Design U.S. Pat. No. 328,985 and U.S. Pat. No. 2,826,857 discloses a lap desk comprising a base and a work surface that may be angled with respect to the base. In addition, U.S. Pat. No. 3,172,636 discloses a portable desk with a tray or storage compartment attached to the work surface that is adapted to hold a variety of articles such as writing implements, clips and thumb tacks. These portable desks are limited to one size and can not be easily expanded to provide an essentially flat work surface which can be oriented to an suitable portion to be chosen by the user if desired.

U.S. Pat. No. 4,564,091 discloses a portable writing board with auxiliary panels that telescope outwardly from the base to increase the work area if necessary but fails to provide a level work area when the telescopic panels are engaged.

U.S. Pat. No. 5,150,873 discloses a portable auxiliary desk top that is designed to interact and enlarge the work surface of a student desk. This patent does not disclose a means for bracing the portable desk when the portable desk is not used in conjunction with a student desk.

It is an object of the present invention to provide a portable desk that can be used in a variety of locations such as a couch, an easy chair, a bed, a car, an airplane, a train, a bus, a floor or outdoors wherein the work surface can be easily expanded to provide an essentially flat work surface.

It is a further object of the invention to provide a portable expandable desk that is light weight and has a slim profile to allow for convenient storage and transport by hand or in a briefcase, student backpack or bookbag.

It is also a further object of the invention to allow a user to select the most appropriate and comfortable angle for use of the work surface by varying the position of the work surface on the user's body and legs.

SUMMARY OF THE INVENTION

The above-mentioned objectives are achieved in the present invention. The present invention comprises a first substantially rigid flat surface member; a second substantially rigid flat surface member; a means for hingedly attaching the first surface member to the second surface member so that the first and second surface members are capable of folding together; and a bracing means for bracing the first surface member and the second surface member in an unfolded position. The bracing means further comprises a gripping means to prevent the bracing means from inadvertently disengaging from the first or second surface member.

In a preferred embodiment of the invention the width of the second surface member is greater than the width of the first surface member. The difference in widths of the surface members creates a storage surface on the second surface member for the storage of the bracing means when the first and second surface members are in a folded position and results in a lower profile for the portable desk that is conducive to storage and transport.

The present invention may also contain a locking means for securing the first and second surface members to each other when the invention is in a folded position, a means for retaining a writing implement, a means for storing paper, a means for positioning and maintaining the invention in an inclined state or any combination of the foregoing.

DETAILED DESCRIPTION OF THE INVENTION

The present invention will be better understood by the following detailed description of a preferred embodiment of the invention and with reference to the drawings.

Figure 1:
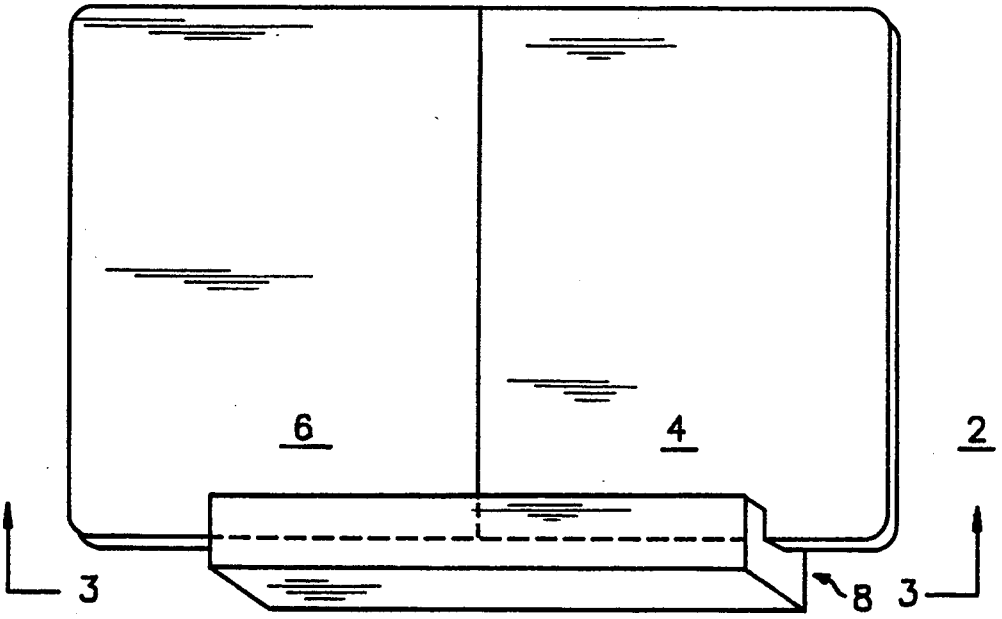
FIG. 1 is a top plan view of a preferred embodiment of the portable expandable desk in an unfolded mode.
Figure 2:
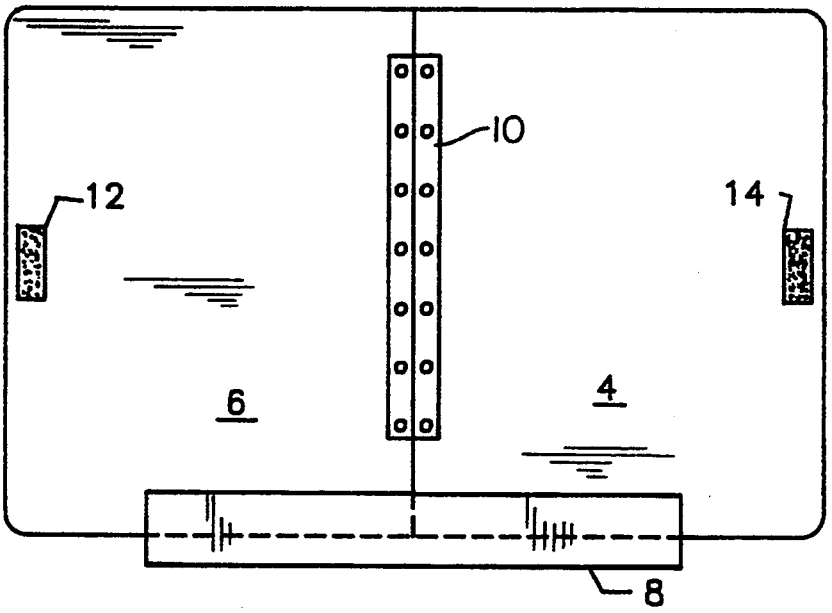
FIG. 2 is a bottom plan view of a preferred embodiment of the portable expandable desk in an unfolded mode.
Figure 3:
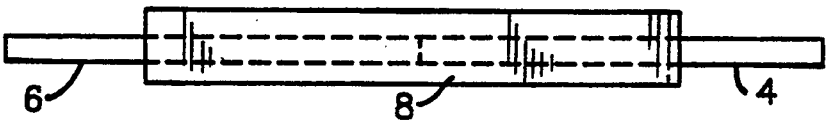
FIG. 3 is side view of a preferred embodiment of the portable expandable desk taken along line 3—3 of FIG. 1.

Referring to FIGS. 1 and 2, the present invention is a portable expandable desk article 2. The portable expandable desk 2 comprises a first substantially rigid flat surface member 4, a second substantially rigid flat surface member 6 and a bracing means 8 for bracing the first surface member 4 and the second surface member 6 in an unfolded position.

The portable expandable desk 2 also comprises a hinge means 10 for attaching the first surface member 4 to the second surface member 6 so that the first 4 and second 6 surface members are capable of folding together.

The bracing means 8 is designed to provide support for the first 4 and second 6 surface members when the portable desk is in an unfolded or expanded position. A primary function of the bracing means 8 is to hold the first surface member 4 and the second surface member 6 in a neighboring position so that the top flat surface of the first surface member 4 and the second surface member 6 form a continuous level work area. The bracing means 8 is designed to form a removable continuous support along the upper or lower adjoining edges of the first surface member 4 and the second surface member 6. FIGS. 1 and 2 show the bracing means along the lower adjoining edges of the first surface member 4 and the second surface member 6.

Figure 7:
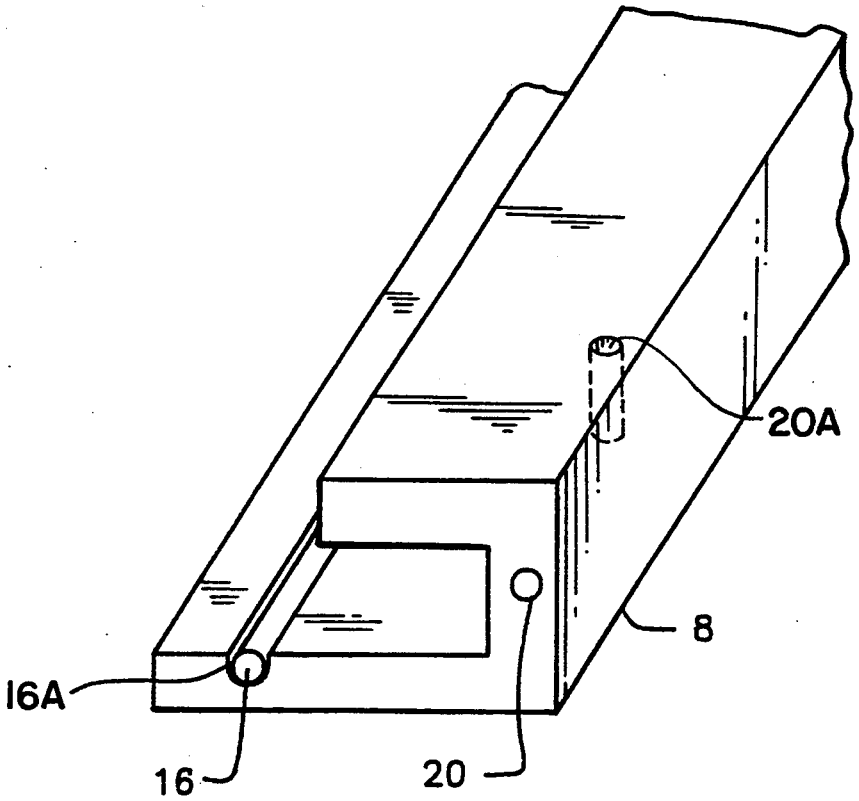
FIG. 7 is a side elevational view of the a preferred bracing means for the portable expandable desk.

A J-shaped bracing means as shown in FIG. 7 is an especially preferred shape for the bracing means 8. The J-shape creates a channel that releasably engages the edges of the first surface member 4 and the second surface member 6.

In one embodiment, the shorter upward portion of the "J" slightly extends onto the top surface of the first 4 and second 6 surface members thereby maintaining a large work area. The larger upward portion of the "J" extends onto the bottom surface to the first 4 and second 6 surface members. This simultaneous extension of the bracing means 8 onto the top and bottom surfaces of the first 4 and second 6 surface members prevents the first 4 and second 6 surface members from folding at the hinge and thereby disrupting the continuous level expanded work area.

In an alternative embodiment, the longer upward portion of the "J" shaped bracing means extends onto the top surface of the first 4 and second 6 surface members while the shorter upward portion of the "J" extends onto the bottom surface to the first 4 and second 6 surface members.

Other shapes for the bracing means 8 are also possible such as a C-shape or an L-shape.

A secondary function of the bracing means 8 is as a support for books or other materials. The bracing means also functions to hold the surface members together in the closed positions.

As shown in FIG. 7, the bracing means 8 comprises a gripping means 16 to prevent the bracing means 8 from inadvertently disengaging from the first 4 or second 6 surface member. Preferably the gripping means 16 is a friction fit strip of rubber, plastic, felt or other similar resilient material or a spring hinge clip. The gripping means will prevent the bracing means 8 from readily disengaging from the first 4 or second 6 surface member until the user exerts sufficient force to remove the bracing means 8 from engagement with the first 4 and second 6 surface members. Gripping means 16 may be affixed to the surface of the bracing means 8 or recessed into a groove 16A which is cut into the surface of the bracing means 8 along the longitudinal axis of said bracing means 8.

An alternative embodiment of the gripping means 16 is a spring hinge similar to the structure present on a clipboard. An additional benefit of the spring hinge gripping means is that it would allow the user to hold work materials to the work surface.

The hinge means 10 may be any type of hinge structure commonly known in the art. In a preferred embodiment the hinge means 10 is a metal hinge approximately ten inches in length and securely attached by screws or rivets to the bottom surface of the first 4 and second 6 surface members as shown in FIG. 2. The hinge may be surface mounted on the first 4 and second 6 surface members or mortised mounted.

Other hinging means 10 can be used to hingeably attach the first 4 and second 6 surface members. For example a strip of any flexible polymeric material capable of withstanding repeated flexings or multiple individual small hinges are useable in the invention.

Figure 4:
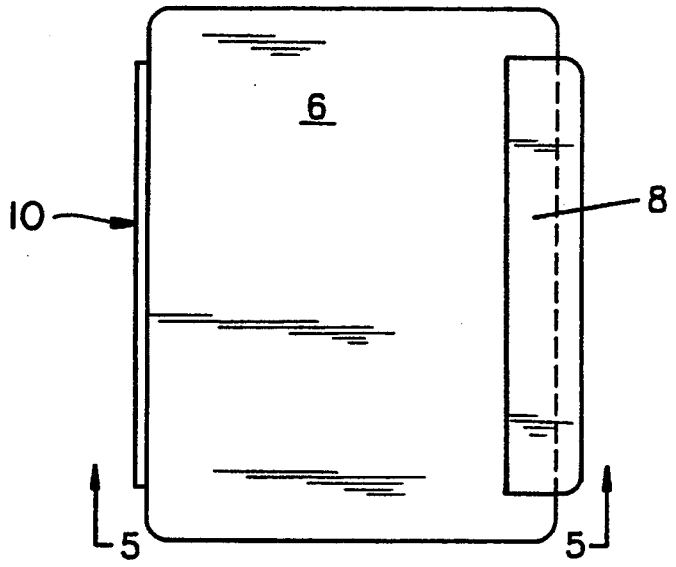
FIG. 4 is a top plan view of a preferred embodiment of the portable expandable desk in a folded mode.
Figure 5:
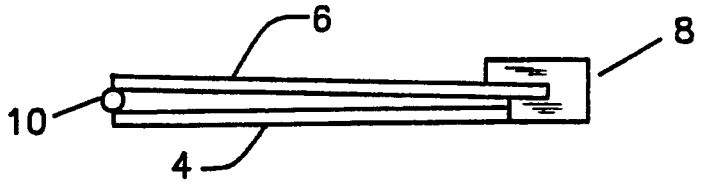
FIG. 5 is a side view of a preferred embodiment of the portable expandable desk in a folded mode, taken along line 5—5 of FIG. 4.
Figure 6:
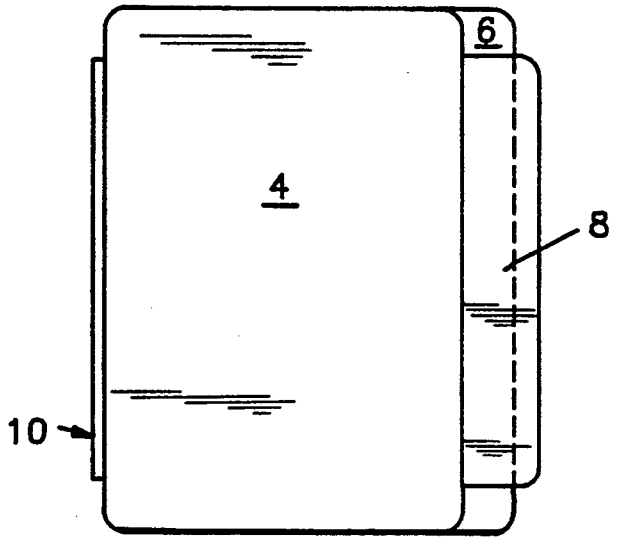
FIG. 6 is a bottom plan view of a preferred embodiment of the portable expandable desk in a folded mode.

The portable expandable desk 2 may also comprise a locking means for securing the first 4 and second 6 surface members together when the portable expandable desk 2 is in the folded position. The locking means may comprise a eye and hook fabric, magnets, a latch or a snap fastener. A preferred locking means is eye and hook fabric such as velcro. As shown in FIG. 2 the velcro strips 12 and 14 are preferably located on the outside edges of the bottom surface of the first 4 and second 6 surface members. This location allows the velcro strips to engage when the first 4 and second 6 surface members are in a folded position as shown in FIGS. 4, 5 and 6.

Figure 5A:
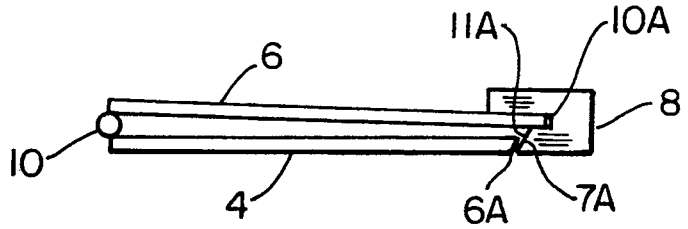
FIG. 5A is a side of an alternate embodiment of the portable expandable desk in a folded mode.

FIG. 5A shows an alternate embodiment of the portable expandable desk where the locking means is based on an angled profile 6A on the first surface member 4 that cooperates to form a locking surface with a complementary angled profile on edge 7A of bracing means 8. Space 10A and 11A are present in FIG. 5A to illustrate the incompletely fitted position of bracing means 8 on the portable expandable desk 2 in order to clearly show the complimentary profiles on angled profiles 6A and edge 7A. When the bracing means 8 is fully engaged on the portable expandable desk 2, the surfaces of angle profile 6A and edge 7A will be in contact to first 4 surface member and second surface member 6 together.

The portable expandable desk 2 may optionally comprise one or a plurality of means for retaining a writing implement. The retaining means may be a clip, pocket or other structure commonly known in the art that is attached to the first 4 or second 6 surface members. As shown in FIG. 7, in a preferred embodiment the retaining means 20 is a hole that is formed in the base of the bracing means 8 or a hole 20A on the upper surface of the shorter edge of the bracing means. The hole 20 or 20A may be oriented in any suitable position and is sized to accept and store a pen or pencil. The hole is preferably tapered to prevent the pen or pencil from passing through the surface.

In an alternative embodiment, the means for retaining a writing implement may be a hole or recess located on the top outside edge of the work surface or along one of the edges of the work surface.

The portable expandable desk 2 may also optionally contain a means for storing paper. One of the preferred means for storing paper is a clip that is attached to the top edge of the bottom surface of the first 4 or second 6 surface member. Another preferred embodiment is a pocket structure attached to the bottom surface of the first 4 or second 6 surface member. Attaching the paper storage means to the bottom surface of the first 4 or second 6 surface member has the advantage of protecting the stored paper when the portable expandable desk 2 is in the folded position and is being stored or transported.

The portable expandable desk 2 may also optionally contain a means for positioning and maintaining the work surface in an inclined state. One embodiment of the means for positioning and maintaining the work surface in an inclined state comprises a substantially rigid member hingeably attached to the bottom surface of the first surface member 4 and a substantially rigid member hingeably attached to the bottom surface of the second surface member 6. The hinged rigid members attached to the bottom of the first 4 and second 6 surface members are hinged to swing from a zero degree angle with respect to the bottom surface of the first 4 and second 6 surface members to any angle with respect to the bottom surface of the first 4 and second 6 surface members greater than zero degrees but less than 180 degrees. Varying the angle of the hinged rigid members with respect to the bottom surface of the first 4 and second 6 surface members allows the user to adjust the angle of use for the work surface.

In a preferred embodiment as shown in FIGS. 5, 5A and 6, the width of the second surface member 6 is greater than the width of the first surface member 4. This unique design specification defines a storage surface for the bracing means 8 on the second surface member 6 when the portable expandable desk 2 is in the folded position. In a particularly preferred embodiment, the first surface member 4 is approximately 14 inches in length and 10.5 inches in width. The second surface member 6 is approximately 14 inches in length and 11 inches in width. The J-shaped bracing means 8 is sized so that the shorter upward portion of the "J" is approximately 0.5 inches to correspond to the 0.5 inches portion of the second surface member 6 that extends beyond the first surface member 4.

The first surface member 4, the second surface member 6 and the bracing means 8 can be fabricated from wood, cardboard, plastic, aluminum, metal or any combination of the foregoing.

The present invention can be used in a variety of operating modes. For example the user may use the invention in a folded or unfolded mode horizontally or vertically, depending on space constraints and requirements.

In the folded mode the user may place the invention on his lap with the bracing means 8, which is in the storage position, nearest his body. This horizontal position is convenient for reading heavier books because the stored bracing means 8 will function as a book rest, thereby freeing the users hands from much of the weight and muscle tension associated with reading. The invention works equally well with the users leg crossed at the knees or ankles or with the legs raised from a reclining position. It is also possible to use the invention by positioning the first 4 and second 6 surface members like an easel on the users legs and torso.

The user may also use the present invention in a vertical folded mode. In this mode, the user places the shorter edge of the folded desk toward him. The bracing means 8 may be removed from the storage area and placed on the shorter edge of the first 4 or second 6 surface members to function as a book rest or left in the storage position for a rest free surface.

The user may also use the present invention in a horizontal or vertical unfolded mode depending on the space constraints. When the present invention is used in the unfolded mode, the user removes the bracing means 8 from the storage position and moves the first surface member 4 and the second surface member 6 about the hinge means until the first 4 and second 6 surface members form a continuous expanded level work area. The bracing means 8 is then placed perpendicular to the line of the hinge means 10. The preferred position for the bracing means is when the hinge means line is at the center of the bracing means 8 (i.e. the bracing means 8 is positioned to cover both the first 4 and second 6 surface members equally) and the bracing means 8 is nearest the user's body.

The above mentioned patents, publications, and test methods are incorporated herein by reference.

Many variations in the present invention will suggest themselves to those skilled in the art in light of the above, detailed description. All such obvious modifications are within the full intended scope of the appended claims.

What is claimed is:

1. A portable expandable desk article comprising a first substantially rigid flat surface member; a second substantially rigid flat surface member; a means for hingedly attaching the first surface member to the second surface member so that the first and second surface members are capable of folding together; and a means for bracing the first surface member and the second surface member in an unfolded position wherein the bracing means comprises a gripping means to prevent the bracing means from inadvertently disengaging from the first or second surface member wherein the width of the second surface member is greater than the width of the first surface member to provide a storage surface for storing the bracing means when the first and second surface members are in a folded position.

2. A desk article as defined in claim 1 further comprising a locking means for securing the first and second surface members in a folded position.

3. A desk article as defined in claim 2 wherein the locking means is also the bracing means.

4. A desk article as defined in claim 2 wherein the locking means is eye and hook fabric.

5. A desk article as defined in claim 1 wherein the first surface member, the second surface member and the bracing means are fabricated from wood, cardboard, plastic, aluminum, metal or any combination of the foregoing.

6. A desk article as defined in claim 1 wherein the gripping means comprise a friction fit resilent material.

7. A desk article as defined in claim 6 wherein said gripping means is made of rubber, plastic or felt.

8. A desk article as defined in claim 1 further comprising a means for retaining a writing implement.

9. A desk article as defined in claim 1 further comprising a means for storing paper.

10. A desk article as defined in claim 9 wherein the paper storage means is a clip, pocket structure or any combination of the foregoing.

11. A desk article as defined in claim 1 further comprising a means for positioning and maintaining the desk article in an inclined state.

12. A portable expandable desk article consisting essentially of a first substantially rigid flat surface member; a second substantially rigid flat surface member that is longer in width than the first surface member; a hinge means for attaching the first surface member to the second surface member so that the first and second surface members are capable of folding together; a bracing means for bracing the first surface member and the second surface member in an unfolded position, that is stored on a portion of the second surface member that extends beyond the first surface member when the first and second surface members are in a folded position; a gripping means for preventing the bracing means from inadvertently disengaging from the first or second surface member; optionally a locking means for securing the first and second surface members in a folded position; optionally a means for retaining a writing implement; optionally a means for storing paper; and optionally a means for positioning and maintaining the desk article in an inclined state.

* * * * *